US008556465B2

(12) United States Patent
Lee et al.

(10) Patent No.: US 8,556,465 B2
(45) Date of Patent: Oct. 15, 2013

(54) ILLUMINATION LAMP

(75) Inventors: Tsung-Chi Lee, Taipei (TW); Po-Wei Li, Taipei (TW); Shih-Chang Hsu, Taipei (TW); Chin-Yin Yu, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 0 days.

(21) Appl. No.: 13/363,478

(22) Filed: Feb. 1, 2012

(65) Prior Publication Data

US 2012/0224360 A1 Sep. 6, 2012

(30) Foreign Application Priority Data

Mar. 1, 2011 (CN) ..... 2011 1 0051036

(51) Int. Cl.
*F21S 4/00* (2006.01)
*F21V 21/00* (2006.01)

(52) U.S. Cl.
USPC .. 362/249.02; 362/362; 362/373; 362/249.01

(58) Field of Classification Search
USPC ..... 362/249.02, 249.01, 294, 362–365, 362/373, 157, 183, 184–186, 190–208
See application file for complete search history.

(56) References Cited

U.S. PATENT DOCUMENTS

| | | | | |
|---|---|---|---|---|
| 6,371,636 | B1 * | 4/2002 | Wesson | 362/545 |
| 7,758,223 | B2 * | 7/2010 | Osawa et al. | 362/547 |
| 8,042,969 | B2 * | 10/2011 | Paik et al. | 362/241 |
| 2010/0290207 | A1 * | 11/2010 | Chan et al. | 362/20 |

* cited by examiner

*Primary Examiner* — David J Makiya
*Assistant Examiner* — Alexander Garlen
(74) *Attorney, Agent, or Firm* — Rosenberg, Klein & Lee

(57) ABSTRACT

An illumination lamp comprises a lamp body, a light-emitting module, a power supply module, and a circuit module. The lamp body defines an inner space. The partitioning unit is disposed in the lamp body for dividing the inner space into a first space for receiving the power supply module, and a second space for receiving the circuit module. Due to the presence of the partitioning unit, thermal convection between the first and second spaces is prevented to reduce adverse influence of a high temperature of the circuit module on the power supply module.

19 Claims, 7 Drawing Sheets

ILLUMINATION LAMP

CROSS-REFERENCE TO RELATED APPLICATION

This application claims priority of Chinese Application No. 201110051036.9, filed on Mar. 1, 2011.

BACKGROUND OF THE INVENTION

1. Field of the Invention

This invention relates to a lamp, and more particularly to an illumination lamp that includes a partitioning unit disposed between a power supply module and a circuit module.

2. Description of the Related Art

A conventional emergency illumination lamp (e.g. disclosed in Taiwanese Utility Model No. M363552) includes a circuit module and a battery unit that are disposed within the same space of a lamp body.

However, in such a lamp structure, since the circuit module is adjacent to the battery unit, a high temperature produced from the circuit module during operation has an adverse influence on the battery unit. That is, the service life of the battery unit is reduced when the battery unit is in a high temperature environment for a long time period.

SUMMARY OF THE INVENTION

The object of this invention is to provide an illumination lamp that can reduce effectively an adverse influence of a high temperature of a circuit module on a power supply module.

According to this invention, there is provided an illumination lamp comprising: a lamp body defining an inner space; a partitioning unit being disposed in the lamp body for dividing the inner space into a first space and a second space; and a circuit module disposed within the second space and electrically connected to the light-emitting module for driving the light-emitting module to emit light.

Due to the presence of the partitioning unit, thermal convection between the first and second spaces is prevented to reduce adverse influence of a high temperature of the circuit module on the power supply module.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
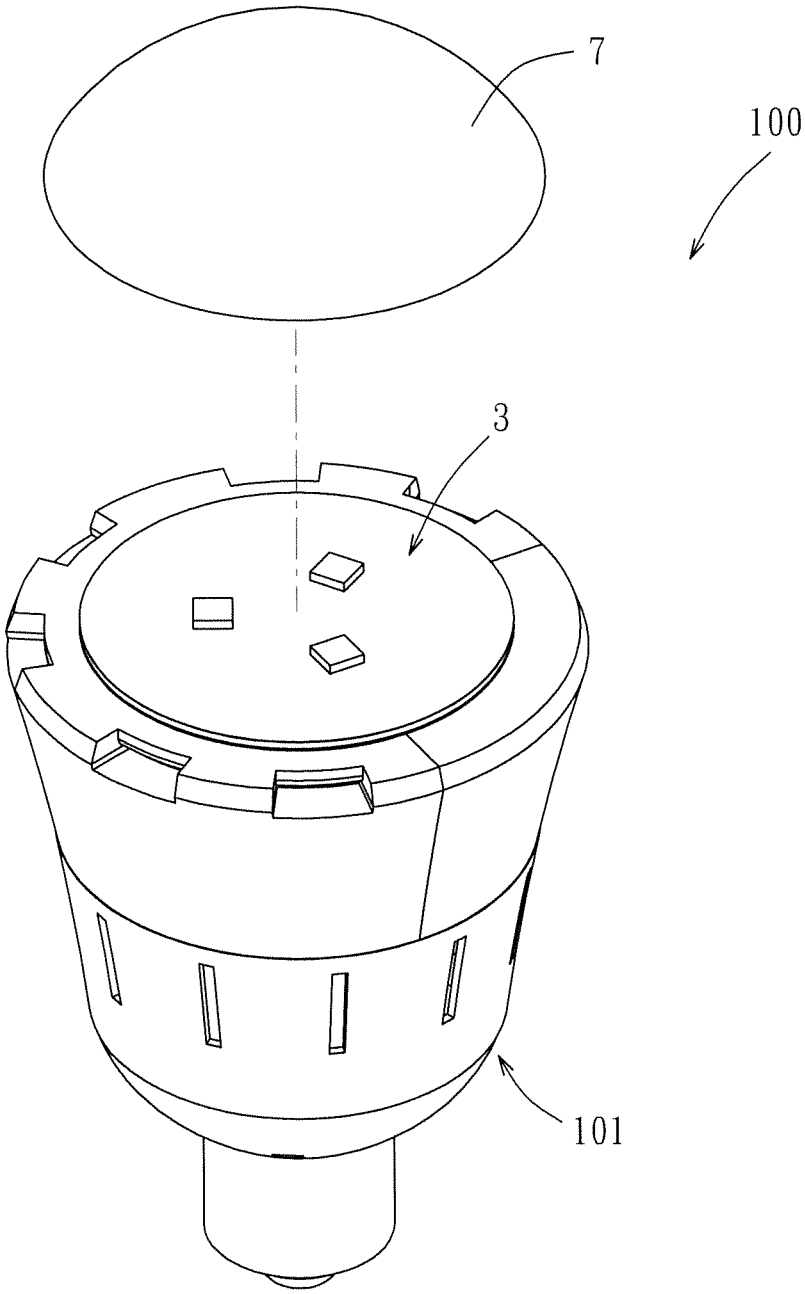
FIG. 1 is a partly exploded perspective view of the preferred embodiment of an illumination lamp according to this invention.
Figure 2:
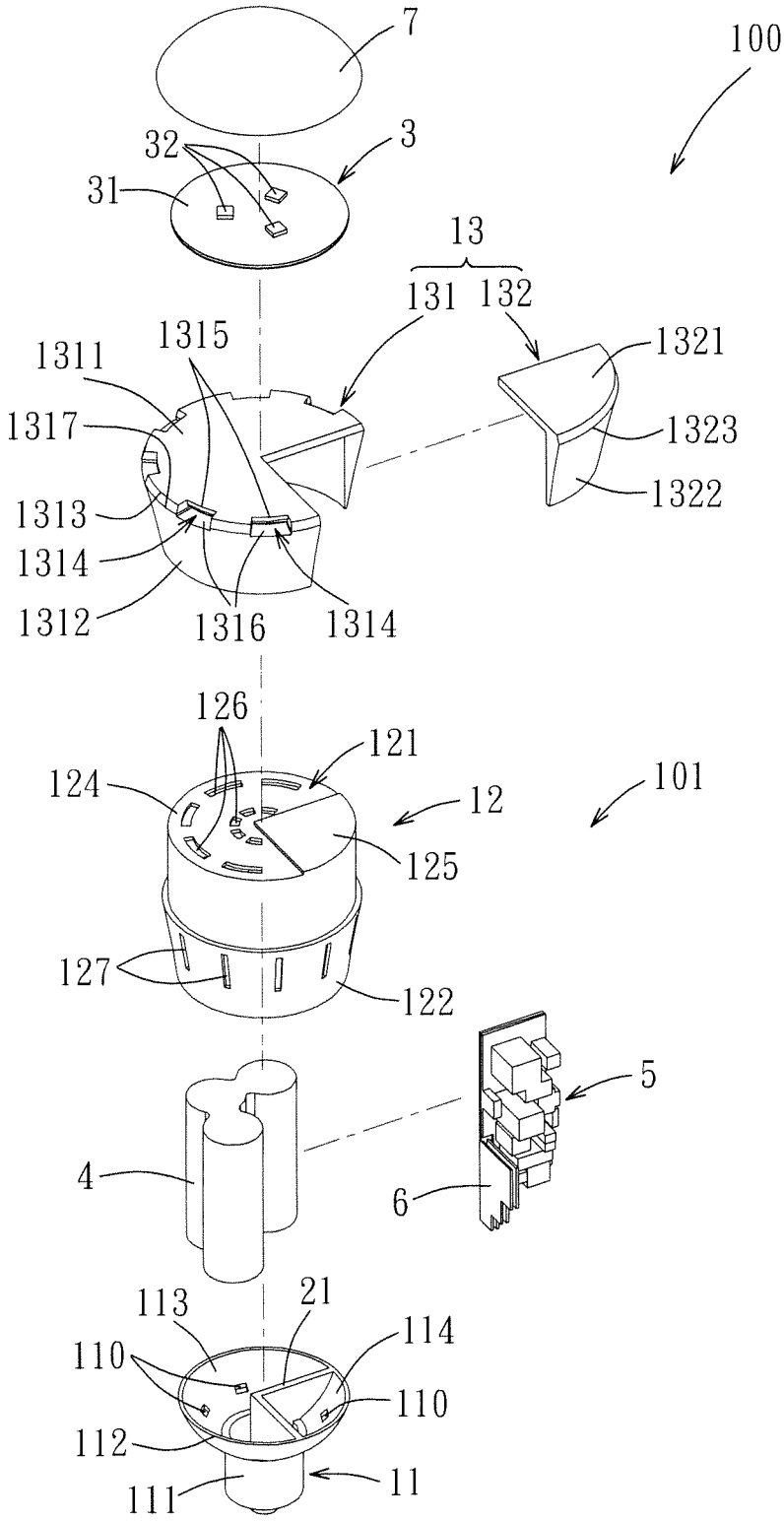
FIG. 2 is an exploded perspective view of the preferred embodiment of an illumination lamp according to this invention.

Referring to FIGS. 1 and 2, the preferred embodiment of an illumination lamp 100 according to this invention includes a lamp body 101, a light-emitting module 3 disposed on the lamp body 101, a power supply module 4, a circuit module 5, a heat-dissipating fin 6, and a cover 7 connected to the lamp body 101 for covering the light-emitting module 3.

Figure 3:
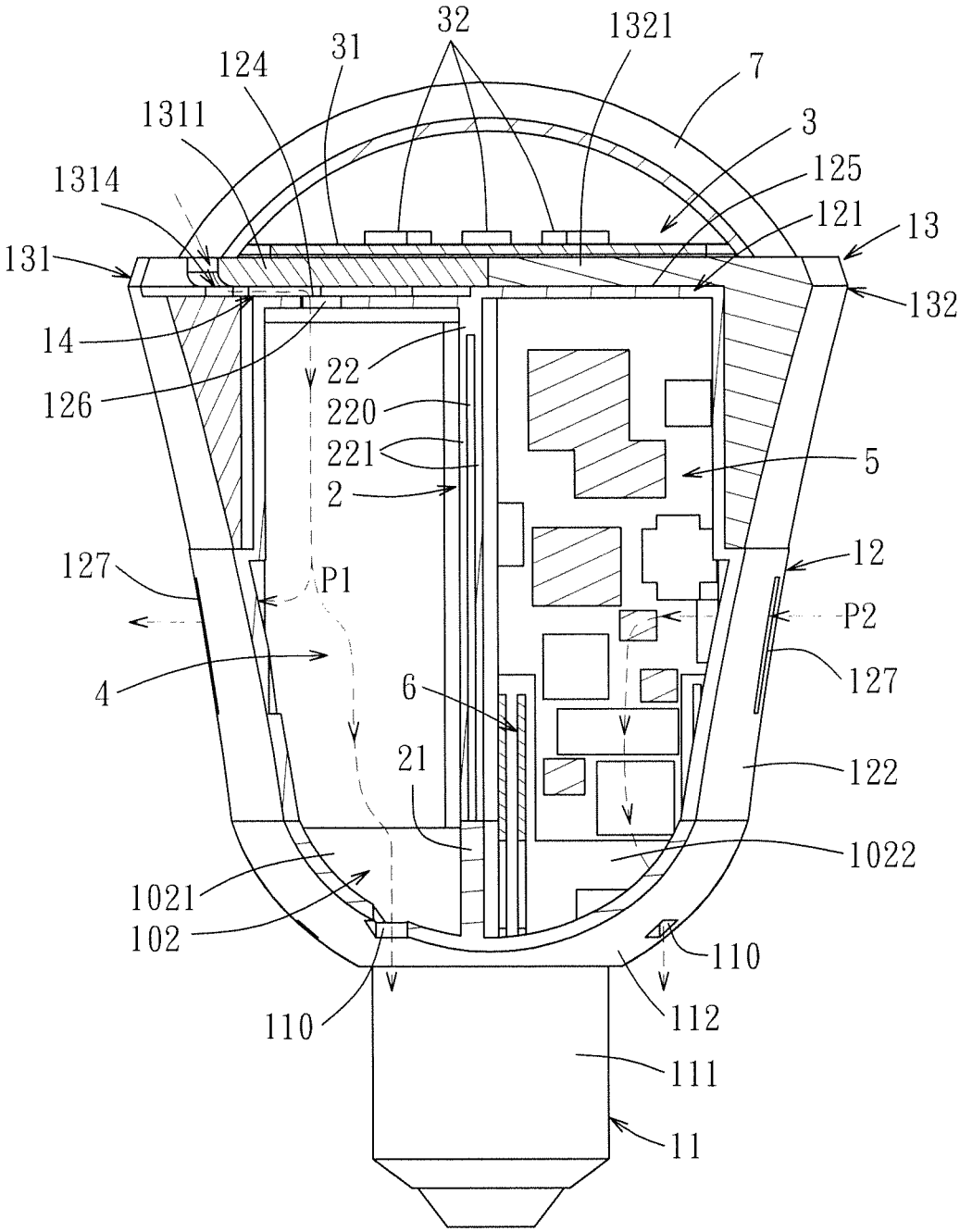
FIG. 3 is a sectional view of the preferred embodiment of an illumination lamp according to this invention.
Figure 4:
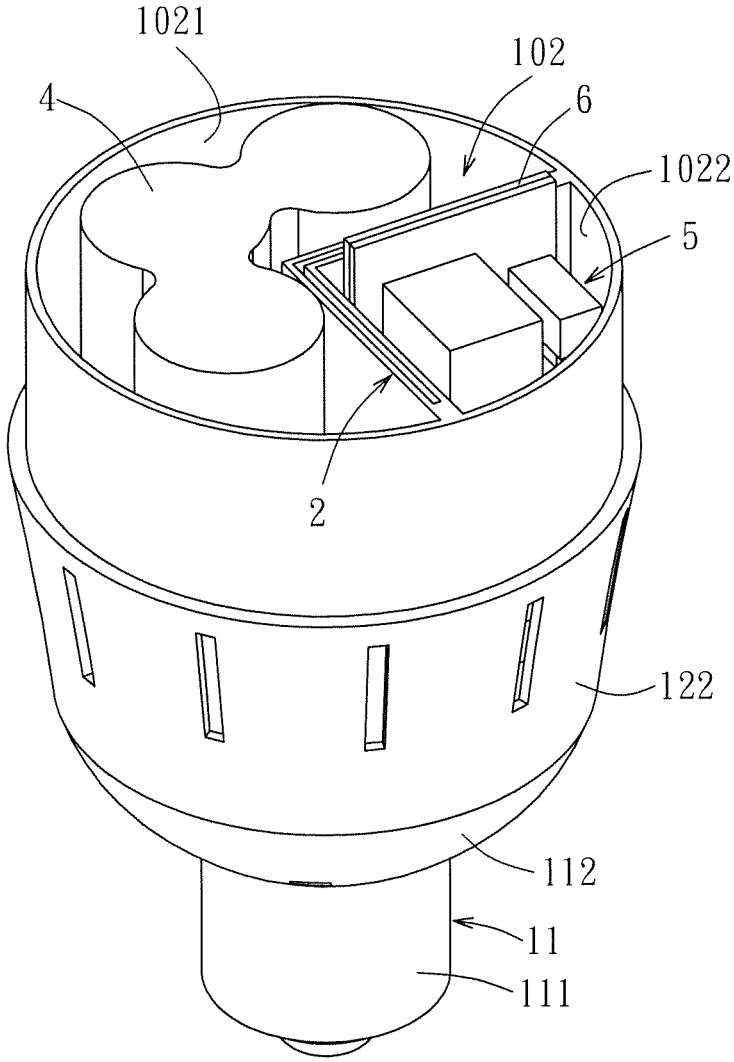
FIG. 4 is a fragmentary perspective view of the preferred embodiment of an illumination lamp according to this invention, illustrating a partitioning unit disposed between a power supply module and a circuit module.

With further reference to FIGS. 3 and 4, the lamp body 101 defines an inner space 102. The partitioning unit 2 is disposed in the lamp body 101 for dividing the inner space 102 into a first space 1021 and a second space 1022 that are not in fluid communication with each other. Preferably, the volume ratio of the first space 1021 to the second space 1022 is 3:1. The power supply module 4 is disposed within the first space 1021. The circuit module 5 is disposed within the second space 1022. In this embodiment, the power supply module is disposed within the first space, but it's not limit thereto. The first space may also be provided for disposing a sensing module for sensing the status of the light-emitting module, so as to switch the lighting mode or adjust the color temperature of the light-emitting module. The partitioning unit 2 prevents airflow between the first and second spaces 1021, 1022. In other words, thermal convection between the first and second spaces 1021, 1022 is prevented to reduce adverse influence of heat generated from the circuit module 5 in the second space 1022 on the power supply module 4. The power supply module 4 may be a battery unit. If this occurs, the illumination lamp 100 is an emergency lamp. However, the power supply module 4 is not limited to the battery unit. As long as the power supply module 4 and the circuit module 5 of the illumination lamp 100 are disposed respectively within two spaces, the illumination lamp 100 falls within the scope of this invention.

In this embodiment, the lamp body 101 includes a lamp holder 11, a main body 12, and a heat-dissipating member 13. The lamp holder 11 includes a conductive connector 111 and a surrounding wall 112 extending upwardly from the conductive connector 111. The surrounding wall 112 of the lamp holder 11 has a plurality of circumferentially arranged apertures 110. The main body 12 includes a top wall 121 and a surrounding wall 122 extending downwardly from the top wall 121. The surrounding wall 122 of the main body 12 has a bottom end that is connected to a top end of the surrounding wall 112 of the lamp holder 11, such that the main body 12 cooperates with the lamp holder 11 to define the inner space 102.

The top wall 121 of the main body 12 has a first top portion 124 (extending an angle of about 270 degrees with respect to a circumferential direction of the top wall 121), and a second top portion 125 (extending an angle of about 90 degrees with respect to the circumferential direction of the top wall 121) that is higher than the first top portion 124. The first top portion 124 is disposed directly above the first space 1021. The second top portion 125 is disposed directly above the second space 1022. The top wall 121 has a plurality of apertures 126 formed in the first top portion 124 and in fluid communication with the first space 1021. The surrounding wall 122 of the main body 12 has a plurality of circumferentially arranged apertures 127.

Figure 5:
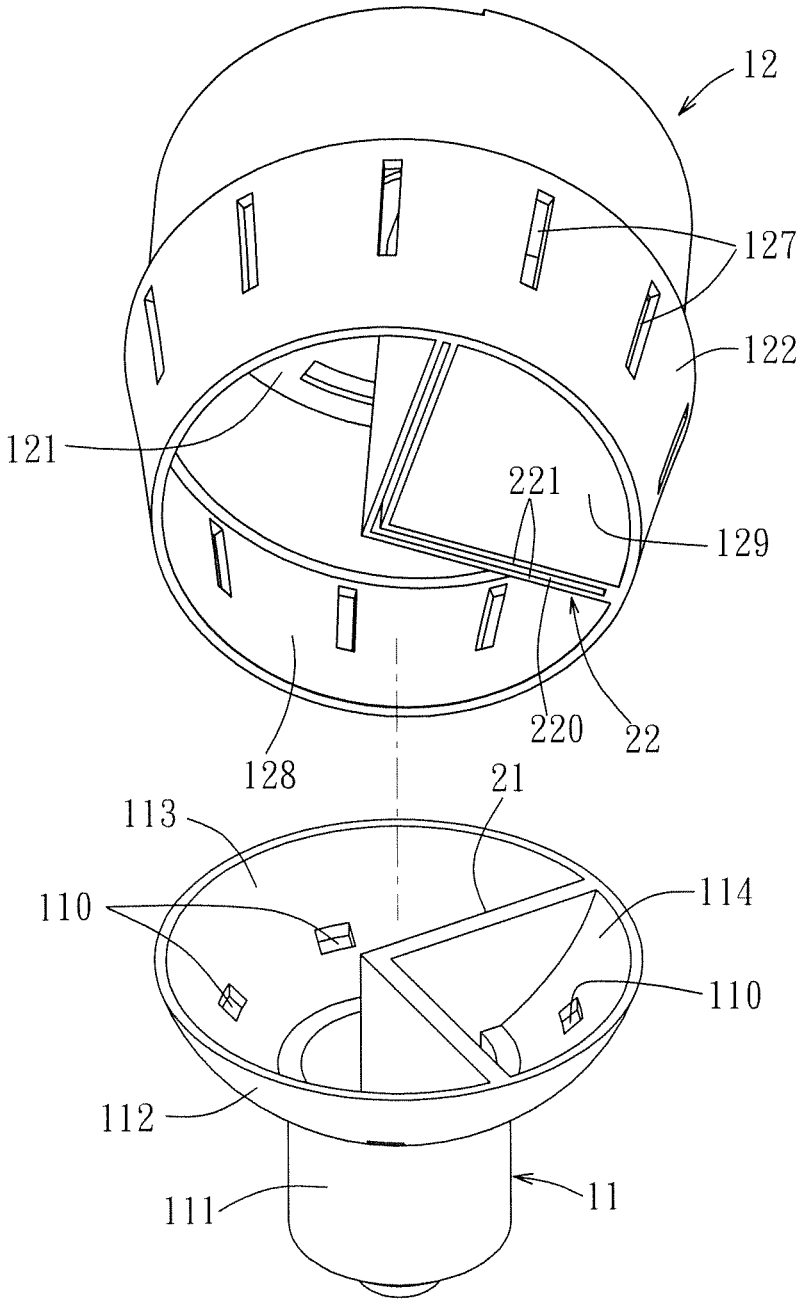
FIG. 5 is an exploded perspective view of a lamp body of the preferred embodiment of an illumination lamp according to this invention.

With particular reference to FIGS. 3, 4, and 5, in this embodiment, the partitioning unit 2 includes a first partition 21 disposed on the lamp holder 11, and a second partition 22 disposed on the main body 12. Cross-sections of first and second partitions 21, 22 are L-shaped. The first partition 21 is connected to an inner surface of the surrounding wall 112 of the lamp holder 11 for dividing a space within the surrounding wall 112 of the lamp holder 11 into a first space 113 and a second space 114. The first space 113 extends an angle of about 270 degrees with respect to a circumferential direction of the surrounding wall 112 of the lamp holder 11. The second space 114 extends an angle of about 90 degrees with respect to the circumferential direction of the surrounding wall 112 of the lamp holder 11. Some of the apertures 110 of the lamp holder 11 are formed in a portion of the surrounding wall 112 corresponding to the first space 113, and the remaining apertures 110 are formed in the remaining portion of the surrounding wall 112 corresponding to the second space 114. The second partition 22 of the partitioning unit 2 is connected to a bottom surface of the top wall 121 and an inner surface of the surrounding wall 122 of the main body 12 for dividing a cylindrical space defined by the surrounding wall 122 into a first space 128 and a second space 129. The first space 128 of the main body 12 extends an angle of about 270 degrees with respect to a circumferential direction of the surrounding wall 122 of the main body 12. The second space 129 extends an angle of about 90 degrees with respect to the circumferential direction of the surrounding wall 122 of the main body 12.

The first and second partitions 21, 22 are interconnected to constitute the partitioning unit 2, such that the first space 113 of the lamp holder 11 and the first space 128 of the main body 12 are in fluid communication with each other to constitute the first space 1021 of lamp body 101, and the second space 114 of the lamp holder 11 and the second space 129 of the main body 12 are in fluid communication with each other to constitute the second space 1022 of the lamp body 101.

It should be noted that, to promote the heat-insulating effect of the partitioning unit 2, in this embodiment, the second partition 22 of the partitioning unit 2 is hollow, and has two plate-shaped portions 221 parallel to each other, and an interlayer space 220 defined between the plate-shaped portions 221. Such a hollow partition structure can reduce heat transmitted from the second space 1022 into the first space 1021 via the partitioning unit 2. The interlayer space 220 is filled with air. Due to high heat resistance of air, heat transmission and heat convection can be prevented effectively.

In alternative arrangements, the lamp holder 11 and/or the main body 12 may be provided with snap-fitting or tongue-and-groove connecting structures, and the partitioning unit 2 may be a separate member connected to the lamp holder 11 and/or the main body 12 by the connecting structures.

Figure 6:
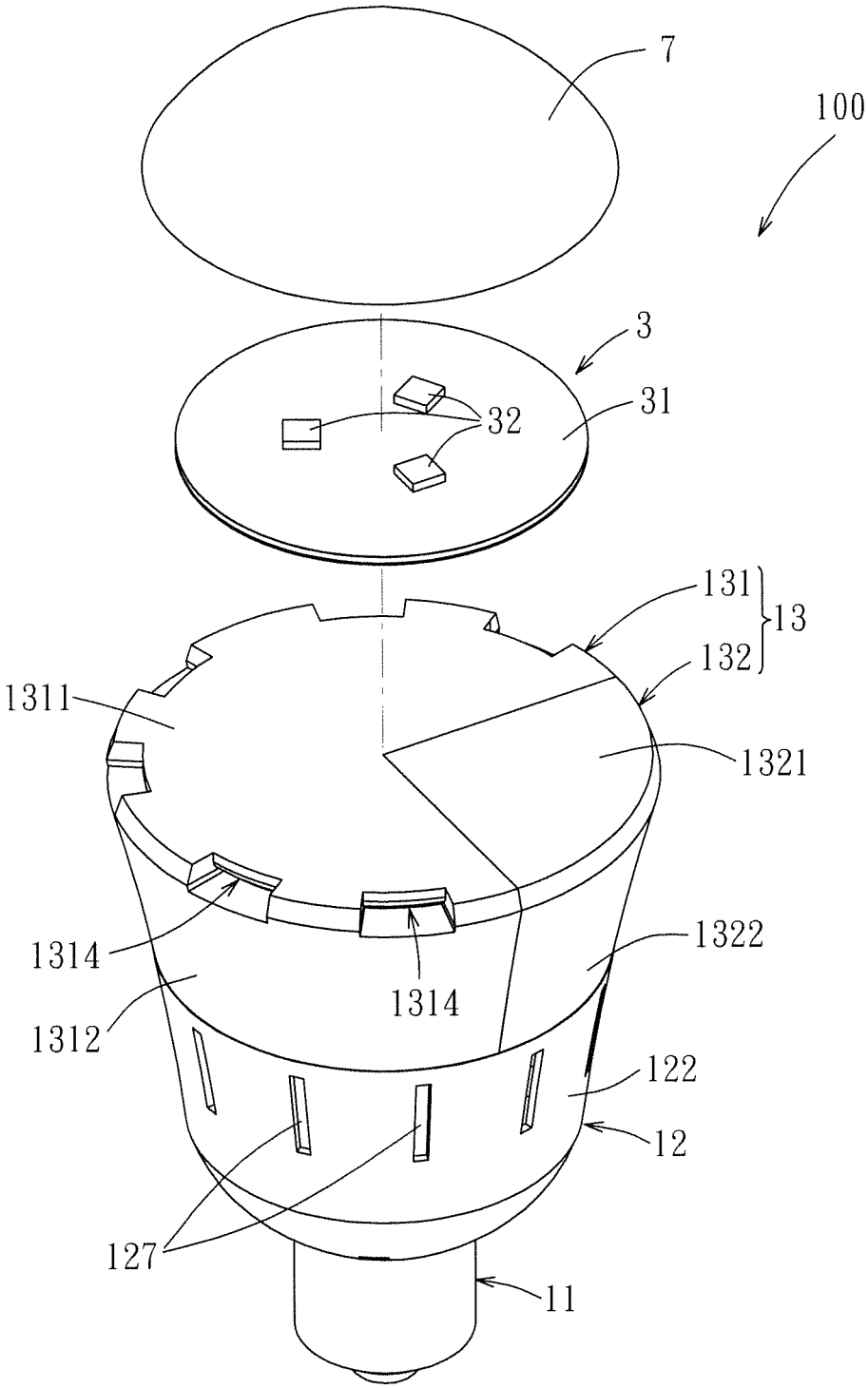
FIG. 6 is a partly exploded perspective view of the lamp body, a light-emitting module, and a cover of the preferred embodiment of an illumination lamp according to this invention.

With particular reference to FIGS. 2, 3, and 6, the heat-dissipating member 13 is connected to the main body 12 for mounting the light-emitting module 3 thereon. In this embodiment, the heat-dissipating member 13 has a shape corresponding to that of the main body 12, and includes a first heat-dissipating component 131 and a second heat-dissipating component 132. The first and second heat-dissipating components 131, 132 are generally inverted L-shaped in longitudinal cross section. The first heat-dissipating component 131 includes a first top wall 1311 and a first sidewall 1312 connected to and extending downwardly from the first top wall 1311. The first top wall 1311 has a first curved outer periphery 1313 extending an angle of about 270 degrees with respect to a circumferential direction of the heat-dissipating member 13. The first sidewall 1312 is connected to the first curved outer periphery 1313. The second heat-dissipating component 132 includes a second top wall 1321 and a second sidewall 1322 connected to and extending downwardly from the second top wall 1321. The second top wall 1321 has a second curved outer periphery 1323 extending an angle of about 90 degrees with respect to the circumferential direction of the heat-dissipating member 13. The second sidewall 1322 extends downwardly from the second curved outer periphery 1323. The first top wall 1311 of the first heat-dissipating component 131 has a profile generally corresponding to that of the first top portion 124 of the main body 12. The second top wall 1321 of the second heat-dissipating component 132 has a profile generally corresponding to that of the second top portion 125 of the main body 12. The first and second top walls 1311, 1321 of the first and second heat-dissipating components 131, 132 are interconnected to form a circular structure for covering the top wall 121 of the main body 12. The first and second sidewalls 1312, 1322 are interconnected to form an annular structure surrounding the surrounding wall 122 of the main body 12. The second top wall 1321 of the second heat-dissipating component 132 is in contact with the second top portion 125. The apertures 127 of the surrounding wall 122 of the main body 12 are disposed below the first and second sidewalls 1312, 1322, and are not concealed.

Since the second top portion 125 of the top wall 121 of the main body 12 is higher than the first top portion 124, an air passage 14 is formed between the first top wall 1311 of the first heat-dissipating component 131 and the first top portion 124 of the main body 12.

In this embodiment, the first heat-dissipating component 131 is made of a plastic material or other material having a low thermal conductivity coefficient, and the second heat-dissipating component 132 is made of aluminum or other material having a thermal conductivity coefficient greater than that of the first heat-dissipating component 131. Due to characteristics of the materials of the first and second heat-dissipating components 131, 132, not only heat can be dissipated quickly from the circuit module 5 via the high thermal-conductivity-coefficient material of the second heat-dissipating component 132, but also heat transmitted from the second heat-dissipating component 132 into the first space 1021 via the low thermal-conductivity-coefficient material of the first heat-dissipating component 131 is reduced to thereby maintain the first space 1021 at a comparatively low temperature.

The first heat-dissipating component 131 further includes a plurality of apertures 1314 in fluid communication with the air passage 14 and the surroundings. The first curved outer periphery 1313 of the first top wall 1311 is formed with a plurality of first notches 1315 so as to have a tooth shape. The first sidewall 1312 has a top side 1317 connected to the first top wall 1311. The top side 1317 is formed with a plurality of second notches 1316 so as to have a tooth shape. The first notches 1315 in the first top wall 1311 correspond respectively to the second notches 1316 in the first sidewall 1312 to form the apertures 1314 of the heat-dissipating member 13. In this embodiment, each of the apertures 1314 of the heat-dissipating member 13 is open in a horizontal direction.

The apertures 1314 of the heat-dissipating member 13, the air passage 14, the apertures 127 of the surrounding wall 122 of the main body 12, and the apertures 110 of the holder 11 are arranged, such that environmental air can be introduced into the first space 1021 through the apertures 1314 of the heat-dissipating member 13 and the air passage 14, to thereby flow back into the surroundings through the apertures 127 of the main body 12 and/or the apertures 110 of the holder 11, so as to form a heat dissipation path (P1) for dissipating heat from the power supply module 4 in the first space 1021.

The light-emitting module 3 is disposed on the first and second top walls 1311, 1321. In this embodiment, the light-emitting module 3 includes a circuit board 31 and a plurality of light-emitting members 32 disposed on the circuit board 31. Preferably, the light-emitting members 32 are light emitting diodes (LEDs). The cover 7 is connected to the heat-dissipating member 13 for covering the light-emitting module 3.

Figure 7:
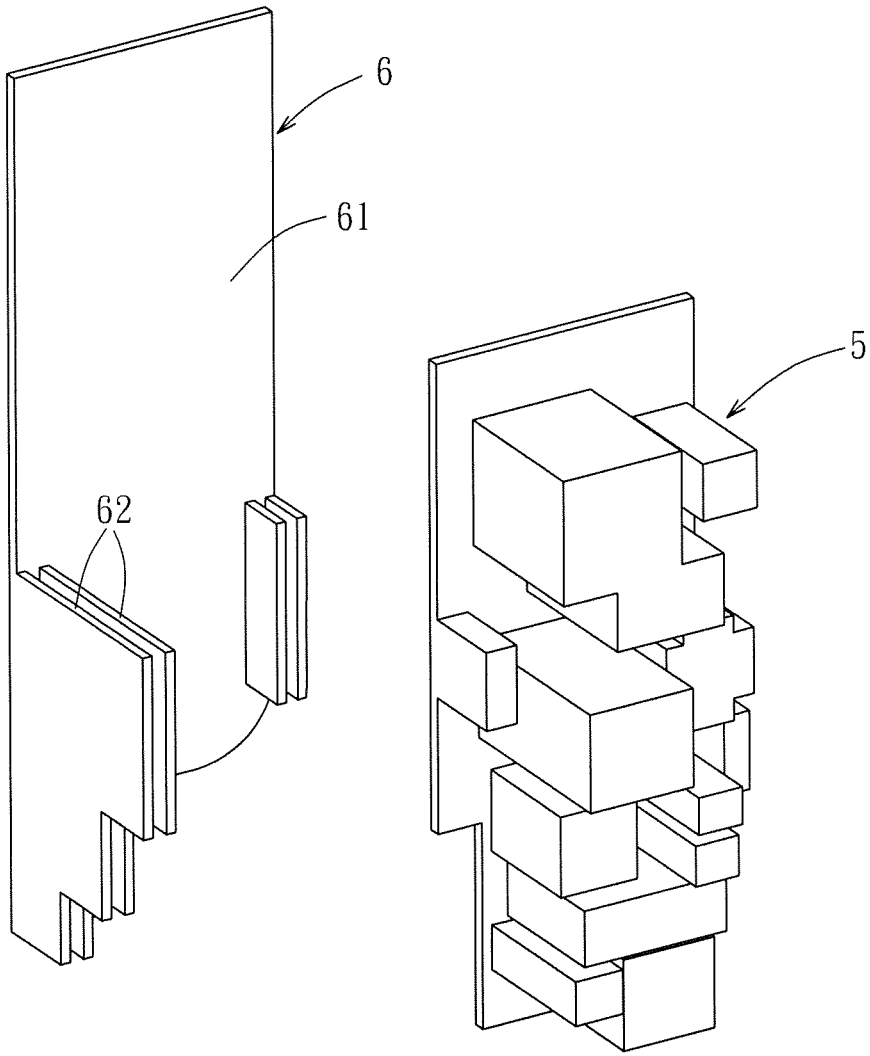
FIG. 7 is an exploded perspective view of a heat-dissipating structure and the circuit module of the preferred embodiment of an illumination lamp according to this invention.

With particular reference to FIGS. 2, 3, and 7, the heat-dissipating structure 6 is disposed in the second space 1022, and includes a mounting plate 61 and a plurality of heat-dissipating fins 62 formed on the mounting plate 61. The circuit module 5 includes a driving circuit disposed on the heat-dissipating structure 6. Since the apertures 127 of the surrounding wall 122 of the main body 12 and the apertures 110 of the holder 11 are in fluid communication with the second space 1022, the environmental air can be introduced into the second space 1022 through the apertures 127 of the surrounding wall 122 of the main body 12, to thereby flow back into the surroundings through the apertures 110 of the lamp holder 11, so as to form a second heat dissipation path (P2) for dissipating heat from the circuit module 5.

To further promote the heat-dissipating effect, heat-conducting material (e.g., heat-conducting paste) having a high thermal conductivity coefficient can be applied on an inner surface of the main body 12, in such a manner to contact a bottom surface of the top wall 121 of the main body 12 and/or an inner surface of the surrounding wall 122 of the main body 12. As such, a portion of heat generated from the circuit module 5 can be dissipated via a path including the heat-conducting material, the top wall 121 and/or the surrounding wall 122 of the main body 12, and the second heat-dissipating component 132 of the heat-dissipating member 13.

In view of the above, due to the presence of the partitioning unit 2, the first space 1021 receiving the power supply module 4 is spaced apart from the second space 1022 receiving the circuit module 5, so as to avoid thermal convection between the first and second spaces 1021, 1022. In this manner, heat transmitted between the first and second spaces 1021, 1022 is reduced to solve the problem of adverse influence of heat generated from the circuit module 5 on the power supply module 4. Thus, the object of this invention is achieved. Furthermore, due to difference between thermal conductivity coefficients of the materials of the first and second heat-dissipating components 131, 132, heat transmitted from the first space 1021 into the second space 1022 is reduced. Further, the apertures 1314 of the heat-dissipating member 13, the apertures 127 of the surrounding wall 122 of the main body 12, the apertures 110 of the holder 11, and the air passage 14 constitute cooperatively heat dissipation paths allowing for dissipation of heat from the first and second spaces 1021, 1022 into the surroundings, thereby enhancing the heat-dissipating effect.

With this invention thus explained, it is apparent that numerous modifications and variations can be made without departing from the scope and spirit of this invention. It is therefore intended that this invention be limited only as indicated by the appended claims.

We claim:

1. An illumination lamp comprising:

a lamp body, said lamp body comprises a lamp holder and a main body that are interconnected to define an inner space therebetween;

a partitioning unit being disposed in said lamp body and extending along an axial direction of said lamp body for dividing said inner space into a first space and a second space that are physically and thermally isolated from each other, said partitioning unit being disposed on at least one of said lamp holder and said main body;

a light-emitting module disposed on said lamp body;

a power source module disposed within said first space; and a circuit module disposed within said second space and electrically connected to said light-emitting module for driving said light-emitting module to emit light.

2. The illumination lamp as claimed in claim 1, wherein said partitioning unit comprises two plate-shaped portions parallel to and adjacent to each other and disposed between said first and second spaces, and an interlayer space defined between said plate-shaped portions.

3. The illumination lamp as claimed in claim 1, wherein said partitioning unit comprises a first partition connected to said lamp holder, and a second partition for connecting said first partition to said main body.

4. The illumination lamp as claimed in claim 1, wherein said lamp holder comprises a conductive connector and a surrounding wall extending upwardly from said conductive connector, said main body comprising a top wall and a surrounding wall extending downwardly from said top wall and having a bottom end connected to a top end of said surrounding wall of the lamp holder.

5. The illumination lamp as claimed in claim 4, wherein said lamp body further comprises a heat-dissipating member connected to said main body, said light-emitting module being disposed on said heat-dissipating member.

6. The illumination lamp as claimed in claim 5, wherein said heat-dissipating member comprises a first heat-dissipating component corresponding to said first space, and a second heat-dissipating component corresponding to said second space, a thermal conductivity coefficient of said second heat-dissipating component being greater than that of said first heat-dissipating component.

7. The illumination lamp as claimed in claim 5, wherein said top wall of said main body has a first top portion disposed directly above said first space, and a second top portion disposed directly above said second space, said second top portion being higher than said first top portion, said heat-dissipating member cooperating with said first top portion of said top wall of said main body to define an air passage therebetween.

8. The illumination lamp as claimed in claim 7, wherein said top wall of said main body has a plurality of apertures formed in said first top portion and in fluid communication with said air passage.

9. The illumination lamp as claimed in claim 7, wherein said first heat-dissipating component has a plurality of apertures in fluid communication with said air passage.

10. The illumination lamp as claimed in claim 7, wherein at least one of said surrounding wall of the said main body and said surrounding wall of said lamp holder is formed with a plurality of apertures at a portion thereof corresponding to said first space, said apertures being in fluid communication with said first space.

11. The illumination lamp as claimed in claim 5, wherein said heat-dissipating member comprises a first heat-dissipating component corresponding to said first space, and a second heat-dissipating component corresponding to said second space, said first heat-dissipating component comprising a first top wall and a first sidewall connected to and extending downwardly from said first top wall, said second heat-dissipating component comprising a second top wall and a second sidewall connected to and extending downwardly from said second top wall, said first and second top walls being interconnected and being disposed on said top wall of said main body.

12. The illumination lamp as claimed in claim 11, wherein said first top wall of said first heat-dissipating component has a first curved outer periphery formed with a plurality of first notches, said first sidewall of said first heat-dissipating component having a top side formed with a plurality of second notches that correspond to said first notches, respectively, said second notches cooperating with said first notches to define a plurality of apertures of said heat-dissipating member.

13. The illumination lamp as claimed in claim 4, wherein said surrounding wall of the main body has a plurality of apertures formed in a portion thereof corresponding to said second space and in fluid communication with said second space.

14. The illumination lamp as claimed in claim 13, wherein said surrounding wall of said lamp holder has a plurality of apertures formed in a portion corresponding to said second space and in fluid communication with said second space.

15. The illumination lamp as claimed in claim 1, further comprising a heat-dissipating structure disposed in said second space, said heat-dissipating structure comprising a mounting plate and a plurality of heat-dissipating fins formed on said mounting plate, said circuit module being disposed on said mounting plate.

16. The illumination lamp as claimed in claim 5, wherein said heat-dissipating member has a shape corresponding to that of said main body.

17. The illumination lamp as claimed in claim 9, wherein said power supply module is electrically connected to said light-emitting module for supplying power to said light-emitting module, and said lamp holder is formed with a plurality of apertures, that cooperate with said apertures of said first heat-dissipating component, said air passage, and said apertures of said main body to form a first heat dissipation path for dissipating heat from said power supply module in said first space.

18. The illumination lamp as claimed in claim 17, wherein said apertures of said main body cooperate with said apertures of said lamp holder to form a second heat dissipation path for dissipating heat from said circuit module in said second space.

19. The illumination lamp as claimed in claim 1, further comprising a heat-conducting material having a high thermal conductivity coefficient and applied on an inner surface of said main body.

* * * * *